United States Patent [19]

Parker

[11] 4,366,882

[45] Jan. 4, 1983

[54] SOUND ROOM

[76] Inventor: Lance Parker, 1465 S. 50 East, Orem, Utah 84507

[21] Appl. No.: 257,930

[22] Filed: Apr. 27, 1981

[51] Int. Cl.[3] ..... E04B 1/82

[52] U.S. Cl. ..... 181/30; 181/141; 181/198; 181/295

[58] Field of Search ..... 181/30, 141, 144, 146, 181/148, 198, 199, 284, 295, 155; 179/1 GA, 1 E; 52/144–145

[56] References Cited

U.S. PATENT DOCUMENTS

| | | | |
|---|---|---|---|
| 1,812,878 | 7/1931 | Karnes | 181/30 |
| 1,845,080 | 2/1932 | Eyring et al. | 181/30 |
| 1,947,287 | 2/1934 | Caldwell | 181/30 |
| 3,379,276 | 4/1968 | Goettl | 181/148 |
| 4,230,905 | 10/1980 | Crum et al. | 181/155 X |

*Primary Examiner*—L. T. Hix
*Assistant Examiner*—Thomas H. Tarcza
*Attorney, Agent, or Firm*—B. Deon Criddle; Terry M. Crellin

[57] ABSTRACT

A sound room having sound wave reflective front and side walls, and ceiling and a sound absorbent floor and rear wall arranged to form a wedge shaped room. Sound generating speakers are positioned at the upper front wall forming the small end of the wedge shaped room so that sound waves emanating therefrom will expand outwardly to fill the room.

8 Claims, 2 Drawing Figures

SOUND ROOM

BRIEF DESCRIPTION OF THE INVENTION

1. Field of the Invention

This invention relates to sound rooms or chambers intended to provide undistorted sound reception to users thereof.

2. Prior Art

Sound rooms, chambers and studios intended to provide for better sound reception for persons therein have long been known. Typically, such rooms, chambers and studios are shown in U.S. Pat. Nos. 1,792,603, 1,812,878, 1,845,080 and 1,947,287. The prior art patents have proposed various structural arrangements to dampen sound or to amplify sound as believed necessary. Generally, however, such structures have included sound absorbing means to dampen reflected sound waves that may otherwise cause echo effects within the room. It has also been proposed in the past to position sound emitting devices at different locations within the room. To the best of my knowledge, however, it has not been heretofore proposed that a sound room be designed such that the advancing sound fronts from a pair of sound emitters and reflected from the walls of the room will provide a true sound reproduction throughout the room.

OBJECTS OF THE INVENTION

Principal objects of the present invention are to provide a sound room having speakers mounted therein such that sound waves emanating from the speakers will mix within the room to give true sound reproduction while preventing bounce back of the sound waves such that the sound will be distorted.

Other objects are to provide a sound room that does not add to or subtract from sound put into the room before that sound is sensed at a central sensing area within a room and that does not reflect such sound to cause later distortions.

Still another object is to provide a sound room that eliminates ear fatigue that can result in poor quality recordings and deafness.

Yet other objects are to provide a sound room that will preserve proper stereo image, without reflections that will cause the ear or other sensor to believe that speakers are located differently than they are actually placed, and to provide a room with high sound efficiency that will insure adequate listening levels without distortion and without fatiguing speakers or amplifiers.

FEATURES OF THE INVENTION

It has been found that the ear, much like the eye, requires a period of time to interpret sensed sounds. Consequently, it is necessary in a sound room to stretch the sounds in time without using reflections that will distort a stereo image, add comb filter effects, and add reverberation not inherent in the sound source.

Principal features of the invention include the use of a wedgeshaped room having an input end wall connected to spaced apart straight side walls, a heavily carpeted, sound absorbing floor, and a straight ceiling at one end thereof. The ceiling, walls, and floor are interconnected in usual room fashion. The other ends of the side walls, floor and ceiling are connected to an absorbent wall and the ceiling and walls each flare outwardly from the input end wall so that the absorbent wall is somewhat larger than the input end wall.

With a sound room constructed as described above, the room is symmetrical to insure a balanced stereo image; the back wall is a trap to all sounds; the ceiling an side walls are straight to provide a flat frequency response and are canted to form a wedge and the ceiling is inclined so that the ceiling and walls are transmitive rather than reflective of sound.

The sound room of the invention has virtually no accoustics of its own. Sounds in the room are stretched in time, thus giving the ear an oportunity to hear and absorb, because of different time arrivals of the sound from different parts of the transmitive surfaces.

Additional objects and features of the invention will become apparent from the following detailed description and claims, taken together with the accompanying drawing showing a preferred form of the invention.

THE DRAWING

In the drawing:

FIG. 1 is a vertical section through a sound room of the invention;

and

FIG. 2, a horizontal section, taken immediately beneath the ceiling of the sound room.

DETAILED DESCRIPTION

Figure 1:
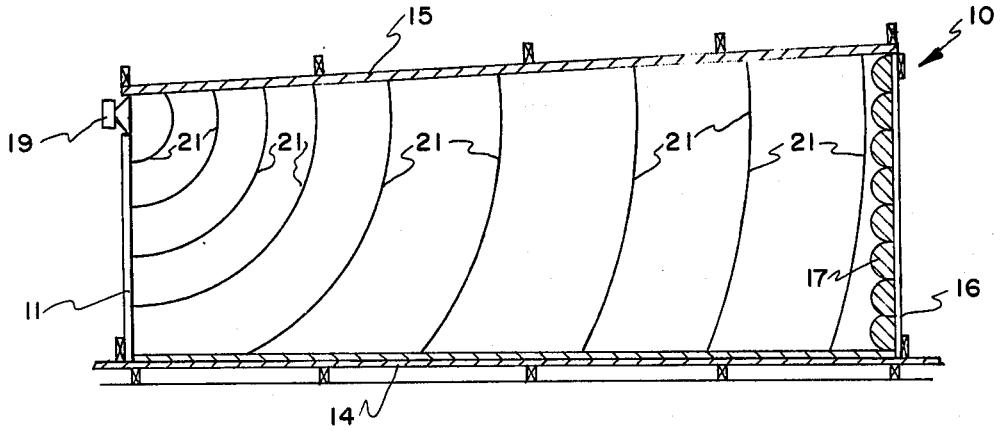

Referring now to the drawing:

In the illustrated preferred embodiment of the invention, the sound room, shown generally at 10 includes an input end wall 11.

The input end wall 11 at one end of room 10 is connected at opposite sides to side walls 12 and 13, respectively, at its bottom to a heavily carpeted, soundproof floor 14 and at its top to ceiling 15. The ceiling and each of the walls 12 and 13 are flared outwardly from the input end wall 11.

An absorbent wall 16 at the end of room 10 also interconnects the floor, side walls and ceiling. A layer of absorbent material 17 is placed against the wall 16 to absorb and dampen sound waves striking the surface of the absorbent material. The layer of absorbent material may be formed of various materials, such as rubber or plastic or may comprise a curtain of heavy fabric or the like.

Speakers 18 and 19 are placed at opposite upper corners of the input end wall 11 and at a distance from the side walls 12 and 13 respectively that is within one-quater wave length of the highest frequency to be reproduced.

The walls 12 and 13, the floor and the ceiling may be made of spaced apart inner and outer surfaces 14 and 15 of conventional building materials such as wood, sheet rock, plastic, etc. The walls are rigidly reinforced. The space between inner and outer surfaces is sand filled, as shown at 16. The inner surfaces are finished in a high gloss finish.

Figure 2:
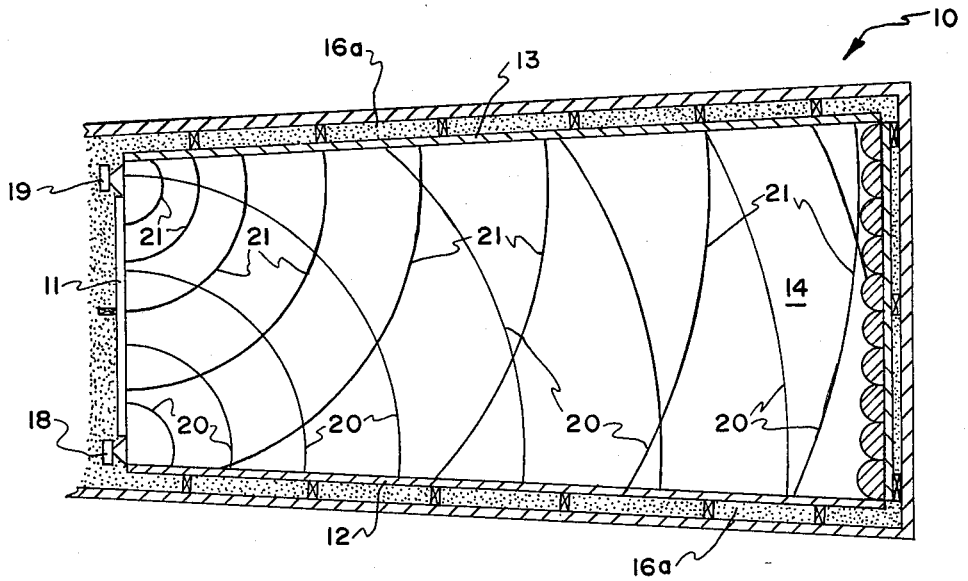

It has been found that the sound waves emitted from the speaker 18 advance as shown by the frontal lines 20, FIG. 2, and that sound waves emitted from speaker 19 advance as shown by frontal lines 21. When the sound waves reach the absorbent wall 17 they are absorbed so that they will not reflect back towards the speakers.

With the room of the invention, a listener positioned centrally in the room or recording equipment so positioned will not be subjected to reflected sound waves, but instead will be subjected to time "stretched" sound waves that are somewhat softer than can be experienced in a conventional box shaped room having the speakers in a traditional location. Ear fatigue is thereby reduced.

Although a preferred form of my invention has been herein disclosed, it is to be understood that the present disclosure is made by way of example and that variations are possible without departing from the scope of the hereinafter claimed subject matter, which subject matter I regard as my invention.

I claim:

1. A sound room comprising an input end wall;

a floor connected to the input end wall and extending therefrom;

a pair of spaced apart side walls, each said side wall being connected to the input end wall and extending therefrom and to the floor;

a ceiling connected to the input end wall and each of the side walls;

a sound absorbent wall spaced from the input end wall and interconnecting the floor, side walls and ceiling, said absorbent wall having a facing of sound absorbent material on the surface thereof facing the input end wall; and a pair of speakers, each of said speakers being mounted at the upper edge of and recessed into the input end wall and tightly adjacent to a side wall, with the sound emanating surfaces of said speakers being within one fourth wavelength of the ceiling and adjacent each side wall and positioned to emit into the room formed by the input end wall, floor, side walls, ceiling and absorbent wall.

2. A sound room as in claim 1, wherein all of the walls are rigidly reinforced.

3. A sound room as in claim 1, wherein the interior surfaces of each of the walls are provided with a high gloss finish.

4. A sound room as in claim 1, wherein all of the walls are double walls rigidly reinforced with sand or the like therebetween.

5. A sound room as in claim 1, wherein the floor is covered with material absorbent to sound.

6. A sound room as in claim 1, wherein the walls are arranged such that the room is smaller from side to side near the input wall than near the absorbent wall.

7. A sound room as in claim 1, wherein the ceiling is higher near the sound absorbent wall than near the input end wall.

8. A sound room as in claim 1, wherein the ceiling and each of the side walls are flared outwardly away from the input end wall.

* * * * *